US005682311A

United States Patent [19]

Clark

[11] Patent Number: 5,682,311

[45] Date of Patent: Oct. 28, 1997

[54] APPARATUS AND METHOD FOR CONTROLLING A HYDRAULIC EXCAVATOR

[76] Inventor: George J. Clark, 7100 Trumble La., St. Clair, Mich. 48079

[21] Appl. No.: 560,537

[22] Filed: Nov. 17, 1995

[51] Int. Cl.[6] ..... G06F 19/00; E02F 3/43

[52] U.S. Cl. ..... 364/424.07; 364/167.01; 37/348; 37/415; 172/4.5; 414/699

[58] Field of Search ..... 364/424.07, 167.01, 364/559; 37/348, 443, 414, 415; 172/4.5; 414/699, 698, 722; 356/375, 138

[56] References Cited

U.S. PATENT DOCUMENTS

| | | | |
|---|---|---|---|
| 4,343,099 | 8/1982 | Ziegler et al. | 37/443 |
| 4,393,606 | 7/1983 | Warnecke | 37/348 |
| 4,726,682 | 2/1988 | Harms et al. | 356/375 |
| 4,829,418 | 5/1989 | Nielsen et al. | 364/167.01 |
| 4,864,746 | 9/1989 | Fukumoto | 37/414 |
| 4,866,641 | 9/1989 | Nielsen et al. | 364/424.07 |
| 4,884,939 | 12/1989 | Nielsen | 414/698 |
| 4,888,890 | 12/1989 | Studebaker et al. | 37/348 |

*Primary Examiner*—Kevin J. Teska
*Assistant Examiner*—Tan Nguyen
*Attorney, Agent, or Firm*—VanOphem Meehan & VanOphem, P.C.

[57] ABSTRACT

A depth measuring apparatus for an excavator which includes an inclination sensor assembly mounted along the pivot axis between the stick arm boom and the bucket, a depth sensor mounted along the same pivot axis as well as a laser receiver for receiving a radiation establishing a reference level mounted coaxially with the pivot axis between the stick arm boom and the bucket such that after the reference level has been established, and the laser receiver is impinged by radiation each time it passes through the reference level, thereby zeroing out the measuring apparatus, the actual depth of a trench may be measured with respect to the reference level by considering the inclination of the bucket as well as the depth displayed by the depth sensor when the bucket is lowered into the trench.

10 Claims, 2 Drawing Sheets

APPARATUS AND METHOD FOR CONTROLLING A HYDRAULIC EXCAVATOR

BACKGROUND OF THE INVENTION

1. Field of the Invention

The present invention relates generally to the use of a laser beam as a reference for controlling an excavation machine and, more particularly, to the method and apparatus wherein an inclinometer, depth sensor and laser beam interact to relate the depth of a trench below the plane of light generated by the laser to a preestablished bench mark.

2. Description of the Prior Art

In the recent past, there has been an increased use of laser beam projection systems in the construction industry. A desirable attribute for an excavator would be one that could easily and quickly dig exactly to a finished grade of a desired depth without the requirement of frequent operator checks or for requiring additional workers in the area. The system should be easy to operate and function properly even though the excavator changes its elevation and altitude frequently. In addition, an excavator should allow the operator to dig to a level grade or to a nonlevel grade having a desired slope or percentage of grade.

One approach to applying laser control to an excavating machine, to expand its capabilities and to permit less skilled operators to dig flat trenches or the like, is disclosed in U.S. Pat. No. 4,231,700, issued Nov. 4, 1980, to Studebaker. The Studebaker system does not attempt to limit movement of the bucket to a plane or stroke. Rather, the disclosed apparatus includes a detector mounted on a downreach boom which is kept in a fixed relationship with respect to a reference plane defined by a rotating laser beam. Although the detector is maintained at a fixed height, the cutting edge of the backhoe falls and rises during the digging stroke due to the pivoting action of the downreach boom. Thus, the bottom of the trench which is dug utilizing the system will not be flat.

Another approach is disclosed in U.S. Pat. No. 4,393,606, issued Jul. 19, 1983, to Warnecke, wherein an excavator uses a reference beam to permit the operator to control the bucket to make linear digging strokes. In the Warnecke system, a sensor is supported upon a mast which is in turn mounted directly to the upper part of the bucket. In Warnecke, the sensor is a visually observable target such that an operator can control the excavator to maintain the laser beam centered upon the target to maintain a desired digging depth. Due to the nature of the bucket support, the orientation of the bucket remains constant throughout its digging stroke such that the desired target height of the beam striking the sensor is unchanged if the desired digging depth is maintained. Unfortunately, in an excavation of any depth, the Warnecke system requires placement of the laser source within the excavation and by locating the sensor on the bucket makes the sensor and the laser source readily susceptible to damage during the normal course of an excavation.

Another approach to laser control of the digging depth of an excavating machine is taught in U.S. Pat. No. 3,997,071, issued Dec. 14, 1976, to Teach. In the Teach system, the angles between an outreach boom and horizontal, the outreach boom and the downreach boom, and the downreach boom and a line drawn to the digging teeth of the bucket are monitored and processed in accordance with trigonometric equations to provide a continuous signal and visual indication proportional to the depth of the digging teeth of the bucket relative to the mounting axis of the outreach boom.

The absolute depth of the digging teeth of the bucket may be determined and displayed in the Teach system by measuring the absolute elevation of the mounting axis of the outreach boom relative to a reference plane defined by a rotating laser beam. In the Teach system, a beam sensor supported upon a movable mast is continuously adjusted such that a defined section of the sensor is engaged by the rotating laser beam. Movements of the mast are monitored to determine the elevation of the axis of the outreach boom from which the absolute elevation of the digging teeth of the bucket can be determined and displayed.

A further example of the attempts which have been made to advance the use of laser controlled excavating machines is disclosed in U.S. Pat. No. 4,129,224, issued Dec. 12, 1978, to Teach. Teach discloses a laser beam sensor unit mounted on the end of a pendular mast pivotally mounted by the boom pivot pin. A vertical motor continually adjusts the vertical height of the mast to keep the laser beam sensor in the plane of the laser beam. A transducer monitors the amount of extension of the mast and produces an electrical signal proportional to the height of the mast and hence proportional to the absolute vertical spacing between the pivot axis of the boom and the laser plane. Angular displacement transducers monitor the angles between the backhoe frame and the boom, between the boom and the stick, and between the stick and the bucket. The position of the bucket cutting teeth with respect to the backhoe can be determined as a trigonometric relationship between the three angles. By combining the distance from the laser receiver to the backhoe and from the backhoe to the cutting edge the true depth of the cut should be determinable.

Such a device has several drawbacks. The laser height seeking detector requires a mast that not only extends above the excavator and is therefore vulnerable to damage, but also requires means such as pendular mounting to maintain the mast vertically aligned. In a conventional excavator, the boom pivot is typically disposed under the cab or other obstruction, so application of a mast becomes impractical. Unfortunately, the mast structure and angle sensing apparatus must be extremely accurate to accurately control the depth of digging of the excavating machine. Hence, this system is relatively complicated and expensive.

In Nielsen, U.S. Pat. No. 4,884,939, a laser actuated depth sensor for an excavator is completely self-contained in the unit and is mounted on the stick of the excavator. The invention provides a visual indication that is located in the field of vision of the operator who is viewing the excavation zone. The sensor provides simultaneous visual indications to the operator of the position of the unit with respect to the laser plane and the orientation of the stick with respect to true vertical. Accordingly, a control cable from the stick mount of the unit to the cab and a separate indicator unit in the cab are not required. The disadvantage of the system is, of course, the fact that in order for the operator to view the excavation, it is necessary to hold the stick and bucket in a straight up-and-down vertical position to become completely accurate. Further, visual indication by the operator lends itself to human error.

Nielsen et al, U.S. Pat. No. 4,829,418, and Studebaker et al, U.S. Pat. No. 4,888,890, both disclose complicated apparatuses for controlling the working depth of a bucket for an excavating machine having an outreach boom which is pivotally attached at one end to the machine, a downreach boom pivotally attached to the opposite end of the outreach boom, a digging bucket pivotally attached to the end of the downreach boom opposite to that to which the outreach boom is attached, and hydraulic power cylinders for moving the pivotally interconnected elements. In Nielsen et al, the angular determinations are made using linear displacement transducers on the cylinders to determine the extension of each cylinder against its retracted position and the angle of movement of the respective downreach or outreach booms is calculated trigonometrically in order to determine the depth of the trench dug by the excavator. The invention includes the use of a laser plane generator that generates a laser plane and which repetitively calibrates the reference coordinate system of the excavator every time the digging stick passes through the laser plane. Studebaker et al also uses the laser beam projection at a reference height and a beam sensor mounted on the outreach boom where the machine detects the beam by means of a plurality of individual sensor locations. The angular orientation of the downreach boom relative to the vertical is detected and a microprocessor controller connected to the beam sensor and the angle sensor repetitively defines, as a function of the angular orientation of the downreach boom, one of the plurality of individual sensor locations as an ongrade sensor location. The microprocessor controller compares the defined ongrade sensor location to the sensor location having detected the laser beam to generate an outreach boom adjustment signal representative of the movement of the outreach boom which is required to maintain the bucket ongrade as the downreach boom is pivoted with respect to the outreach boom.

Accordingly, the prior art clearly shows a need for a simplified method and apparatus for operating an excavating machine in a manner such that an operator is able to grade to a level grade or a nonlevel grade having a desired slope or percentage of grade.

SUMMARY OF THE INVENTION

The present invention provides a method and apparatus for controlling an excavator to position the cutting edge of a scoop or bucket and digging a cut to a desired depth with extreme accuracy. The invention enables the depth of the digging bucket relative to a set reference position to be easily determined directly by a simple sensor combined with an inclinometer specifically located on the pivot center of the bucket. The simple measuring apparatus critically located on the excavator avoids the use of complicated measuring equipment and associated calculation techniques.

The present invention is used in conjunction with a laser plane generator that generates a laser plane and which repetitively recalibrates the reference position of the excavator every time the pivot axis of the bucket passes through the laser plane. In this manner, the depth measuring control will be frequently and repetitively calibrated as the excavator hauls bucket loads of dirt out of the ditch and will thus compensate for frequent movement of the excavator frame without requiring time consuming reestablishment of the frame location. By continuously generating a level signal indicative of a relative position of the pivot axis of the bucket with respect to an established reference level, and combining the signal with an inclination signal indicative of the inclination of the bucket, the position of the bucket cutting edge with respect to the laser plane can be accurately determined and compared to a desired cutting depth to determine the exact depth of the ditch.

A further embodiment of the depth measuring apparatus according to the invention contemplates the use of a second inclinometer at the top of the stick between the boom of the excavator and the stick in combination with a laser plane generator that may be mounted either at the pivot point of the bucket or on the stick itself. The present invention can be utilized for cutting a sloping grade, such as needed for laying drain tile or the like. Just as the appropriate controls provide precise monitoring of the generally vertical coordinates of the position of the cutting edge, the depth measuring control is also capable of precise determination of the generally horizontal coordinates of the cutting edge position. The above described calibration method is used to determine both the vertical and horizontal components of the distance between the laser receiver and the frame at the moment the receiver crosses the laser plane. Therefore, the depth measuring control will be aware of the distance that the cutting edge is below the laser plane and horizontally away from the point where it was when the laser receiver crossed the laser plane. By continually adjusting the desired depth for the changing cutting edge horizontal position and desired percent of grade, the cutting edge can be guided on a precise slope. Additionally, it is contemplated that the laser plane would be inclined to match the desired percent of grade, so the desired depth would be recalibrated every time the receiver crosses the laser plane just as it was when cutting on a level plane. By monitoring the angle between the boom and the stick and between the bucket and the stick through the use of inclinometers, the relationship between the position of the boom and the angular displacement of the boom is readily determinable through trigonometric relationships. This calculation is carried out by an onboard computer which also receives a signal from a depth gauge in order to detect real time control of the excavating machine.

An object of the present invention is to provide a simple depth measuring apparatus which enables the depth of an excavating bucket to be determined relative to a reference level by a simple measuring process with reliable results.

It is a further object of the present invention to effect the foregoing object with the depth measuring apparatus which an be easily installed at the pivot axis of the bucket and combined with an inclinometer also mounted along the pivot axis of the bucket to provide depth measurements with respect to a laser mounted on site and calibrated with respect to a bench mark.

It is a further object of the present invention to effect the foregoing object with a depth measuring apparatus which is significantly simplified compared to prior art devices.

It is a further object of the present invention to effect the foregoing objects with a depth measuring apparatus which is significantly less expensive than the prior art devices due to its simplicity.

Other objects and advantages of the present invention will become apparent from the following detailed description of the invention which follows with reference being made to the accompanying drawings.

DETAILED DESCRIPTION OF THE PREFERRED EMBODIMENT

Figure 1:
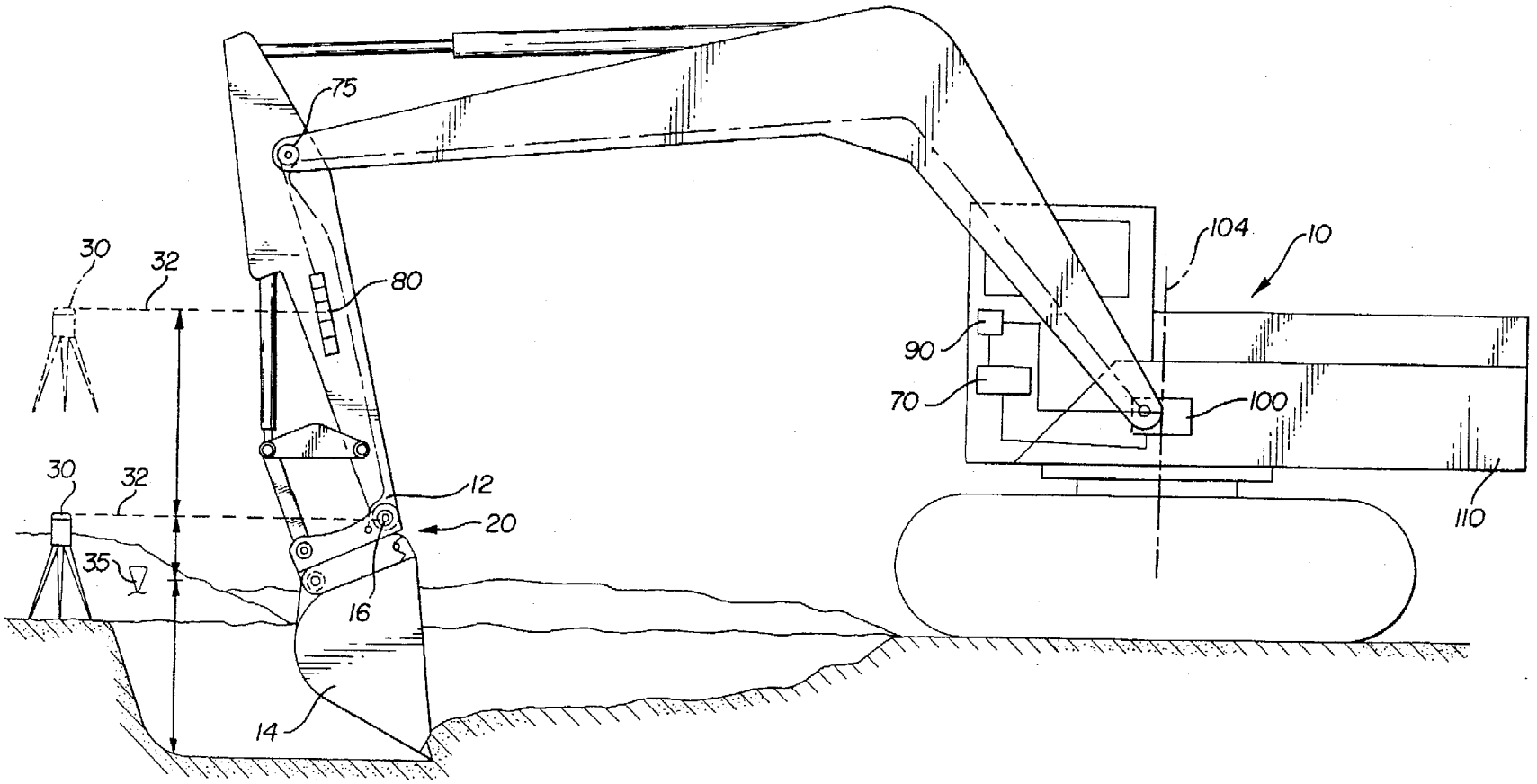
FIG. 1 is a side view of one embodiment of the invention, illustrating the manner in which the depth measuring apparatus is implemented on site with a depth sensor and inclinometer mounted along the pivot axis of the bucket.
Figure 2:
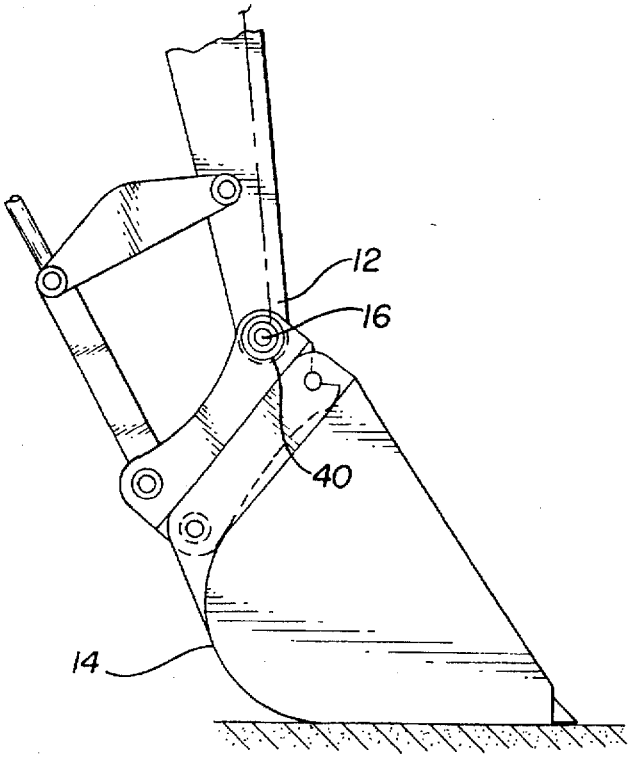
FIG. 2 is a side view of the invention, illustrating the depth sensor and inclinometer mounted along the pivot axis of the bucket.
Figure 3:
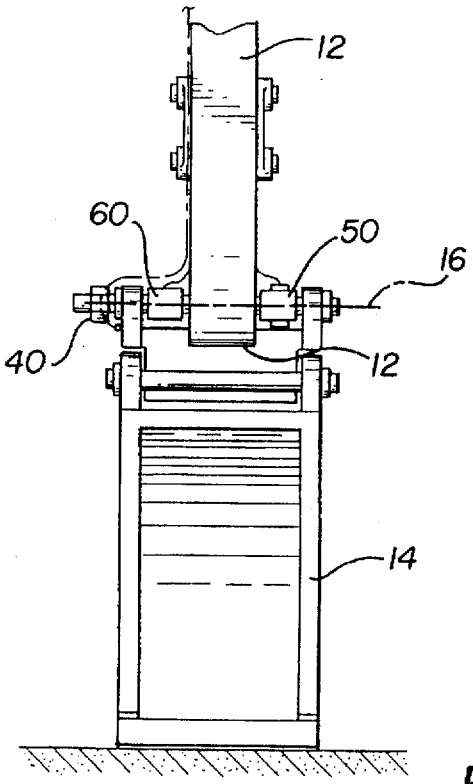
FIG. 3 is a partial elevational view of the invention shown in FIG. 2.

Referring to the drawings, FIGS. 1 through 3 illustrate an excavating machine 10 in use with a laser generator or transmitter 30. The laser generator 30 produces a narrow beam that revolves in a plane. With the laser generator 30 properly aligned with respect to the true horizontal orientation of the surface, it will produce a generally horizontal laser plane 32; however, the invention contemplates the use of an excavator with a laser plane that is non-horizontal as well. Such laser is well known in the art of surveying and grading and the specific construction thereof forms no part of the invention. Also shown is a grade stake 35 which is placed in the ground by a surveying team during establishment of the work site and provides an elevational bench mark with respect to which the desired depth of various trenches and holes can be measured. Mounted at the end of a stick arm 12 is a bucket 14.

A depth measuring apparatus 20 according to the present invention is mounted concentric to a pivot axis 16 between the bucket 14 and the end of the stick arm 12. The depth measuring apparatus 20 includes a depth measuring sensor 40 combined with an inclination sensor 50 for measuring the inclination of the bucket relative to the vertical. Also mounted concentric to the pivot axis 16 is a laser receiver 60 for receiving a radiation generated by the laser transmitter 30 for establishing the reference plane at a reference level. The laser receiver 60 is mounted along the pivot axis 16 where it will intersect the laser plane 32 substantially every time the bucket 14 is withdrawn from or inserted into a trench during the normal course of emptying a load of dirt from the bucket 14. At the instant the beam contacts the receiver, the laser receiver will produce an output that is supplied to a microprocessor 70 mounted in the cab of the excavating machine. The depth measuring sensor 40 and the inclination sensor 50 also provide outputs which are supplied to the microprocessor 70 such that at the very instant the laser receiver penetrates the laser plane, the depth measuring sensor and inclination sensor are calibrated to a known reference level with respect to the grade stake 35. The depth sensor provides a signal to a depth sensor receiver 100 mounted coincident with a swing axis 104 of a main frame 110. The receiver supplies the signal to the microprocessor and as an alternative can provide a visual output to the operator of the excavator. Mounting the depth sensor receiver coincident with the swing axis eliminates the effect of the inclination of the excavator with respect to the horizontal on the liquid depth level device read out device. As the excavating machine lowers the end of the stick arm 12 into the trench, upon passing through the reference laser plane 32 to the bottom of the trench, the depth measuring sensor combined with the inclination of the bucket accurately reflects the depth of the trench. Again, this input is transmitted to the mircoprocessor to be read out by the operator of the excavating machine. In the alternative, a liquid level depth sensor combined with an electronic signal generating depth sensor may be used to provide the operator of the excavating machine with a visual representation of the depth of the trench through a depth sensor read out 90. Each movement of the boom and the stick arm that causes the pivot axis 16 to penetrate the laser plane 32 results in a recalibration of a reference level from which the movement of the depth measuring sensor 40 and inclination sensor 50 mounted along the pivot axis of the bucket may be determined to provide accurate measuring of the depth of a level ditch. Accordingly, the mounting of the depth measuring sensor 40 and inclination sensor 50 coaxial with the pivot axis 16 between the bucket 14 and the end of the stick arm 12 provides for a simple and economical means of accurately displaying to an excavator operator the depth of the ditch without the need for knowledge of the angle of the stick arm or boom. It is contemplated that the depth measuring apparatus 20 can be provided by a single device mounted about the pivot axis 16 which combines the function of the depth measuring sensor 40, the inclination sensor 50, as well as the laser receiver 60.

When it is desired to cut a trench on the grade then the horizontal position of the cutting edge becomes a necessary variable because the desired depth of the trench varies according to the horizontal position of the cutting edge. Just as the vertical distance of the cutting edge with respect to the pivot axis 16 of the bucket 14 is related to the angle between the bucket and the depth of the pivot axis of the bucket, the horizontal distance between the cutting edge and the pivot axis of the stick arm is related to the angle of the stick arm with respect to a vertical line. In order to determine the angle of the stick arm, an inclination sensor 75 is mounted at the pivot point of the stick arm and the boom. Further, photo receptors 80 are mounted on the stick arm and the laser generator 30 is located with respect to the grade stake 35 to provide a beam about a vertical axis so that rotation of the laser beam extending perpendicular to this axis results in a reference plane being established. With such arrangement the laser receiver 60 is deactivated since the photo receptors provide the same function as the laser receiver 60 and the use of the laser receiver 60 would be redundant. As mentioned hereinabove, each time the photo receptors 80 pass through the plane generated by the laser generator 30 and, at the instant the beam contacts the photo receptors 80, the microprocessor 70 receives an output indicative of the calibration level or zero position of the photo receptors 80 with respect to the grade stake 35. Accordingly, a horizontal laser reference plane is established. A vertical reference plane that is needed in order to properly calculate the depth of a sloping grade is established initially by aligning the inclination sensor 75 with the inclination sensor 50 and the cutting point of the bucket in a vertical position in line with the inclination sensor 50 and inclination sensor 75. When this position is obtained both the horizontal and vertical reference levels are established at which point the microprocessor 70 is zeroed out, from which point the microprocessor 70 can easily determine the sloping grade of the trench. For example, each time the photo receptors 80 pass through or penetrate the laser plane 32, the photo receptors 80 will produce an output that is communicated to the microprocessor 70 to reflect the horizontal reference level position or laser plane 32. As the end of the stick arm 12 is lowered into the trench and the stick arm is pivoted about its pivot connection with the boom, the inclination sensor 75 will accurately provide an output of the angle of the stick arm on a continuous basis to the microprocessor 70. Further, with knowledge of the inclination of the stick arm as well as with knowledge of the depth measuring sensor 40 and the inclination of the bucket, the microprocessor 70 can easily compute the location of the cutting edge of the bucket in order to simply locate the position of the bucket or grade of the ditch along the horizontal direction by appropriate programmed functions. Again, as stated earlier, by mounting the depth sensor about the pivot axis 16 of the bucket 14 and the stick arm, it is not necessary to maintain measurement of the angular position of the boom, thereby simplifying the measurement of a graded or leveled ditch.

It is understood that the above disclosure is merely a preferred embodiment of the invention. Changes and modifications in the generally described embodiments can be carried out without departing from the scope of the invention. The inclination sensors and depth sensor described above are intended to be commercially available angular displacement monitors provided for monitoring the angles between excavating members. Also, one skilled in the art may choose to utilize various prior art control systems in combination with the microprocessor in order to obtain the desired read outs and in order to be compatible with the signals generated by the depth sensor and inclination sensors. Further, it is contemplated that the signals generated by the various read out devices can be combined with other input to, for example, avoid coming into contact with underground or overhead cables. It is also contemplated that a single device may be mounted concentric with the pivot axis 16 to provide the combined read outs of the laser receiver 60, depth sensor 40, and inclination sensor 50. The criticality of the invention lies in the location of the depth sensor and inclinometer along the pivot axis between the bucket and the stick arm, although it is contemplated that the type of read out devices used to generate the appropriate signals for the microprocessor may be many.

What is claimed is:

1. An excavator apparatus for use with a laser emitting a planar laser beam at a predetermined elevation for controlling the working depth of a bucket of an excavating machine having an extension boom pivotably attached about a first pivot axis at one end to said excavating machine, a stick arm boom pivotably attached about a second pivot axis to the opposite end of said extension boom, a digging bucket pivotably attached about a third pivot axis to the end of said stick arm boom opposite to that to which said extension boom is attached, and power means for producing relative pivotal movement of the pivotably interconnected elements, said excavating apparatus comprising:

laser beam radiation transmitter means mounted proximate said stick arm boom for projecting a beam of laser radiation at a reference level;

means for receiving said beam of laser radiation mounted to said stick arm boom of said excavating machine, said laser beam radiation transmitter means and said means for receiving said beam of laser radiation establishing a reference level signal;

means for sensing a depth signal indicative of the vertical location of said third pivot axis relative to said reference level, said depth signal sensing means mounted concentrically with said third pivot axis and generating a depth signal indicative of the vertical position of said third pivot axis with respect to said reference height;

an inclination sensor mounted along said third pivot axis on said digging bucket for generating an inclination signal indicative of the inclination of said digging bucket about said third pivot axis;

means for communicating said reference level signal, said depth signal, and said inclination signal to the operator's cab of said excavating machine; and calculating control computing means mounted in said operator's cab for receiving said reference level signal, depth signal and inclination signal and calculating said working depth of said digging bucket, said computing means including means for communicating and displaying said working depth such that the operator of said excavating apparatus visually monitors said working depth.

2. The excavating apparatus as claimed in claim 1 wherein said means for receiving said beam of laser radiation is mounted to said third pivot axis, whereby said depth signal, inclination signal and reference level signal are communicated to said computing means to communicate the working depth of said digging bucket.

3. The excavator apparatus as claimed in claim 2 further comprising:

second means for receiving said beam of laser radiation mounted to said stick arm boom of said excavating machine, said second receiving means being mounted a predetermined distance from said third pivot axis and communicating with said laser beam radiation transmitter means to establish said reference level signal; and a second inclination sensor mounted to said second pivot axis for generating a second inclination signal representative of the angular position of said stick arm boom as compared to a vertical reference plane;

wherein said laser beam radiation receiver means is mounted concentric with said third pivot axis.

4. The excavator apparatus as claimed in claim 3 wherein said second means for receiving said beam of laser radiation comprises a plurality of receiver units disposed along said stick arm boom to generate an output level signal when impinged by said laser radiation, said output level signal reflecting the horizontal position of said plurality of receiver units with respect to a bench mark position.

5. The excavator apparatus as claimed in claim 1 further comprising:

second means for receiving said beam of laser radiation mounted to said stick arm boom of said excavating machine, said second receiving means being mounted a predetermined distance from said third pivot axis and communicating with said laser beam radiation transmitter means to establish said reference level signal; and a second inclination sensor mounted to said second pivot axis for generating a second inclination signal representative of the angular position of said stick arm boom as compared to a vertical reference plane;

wherein said laser beam radiation receiver means is mounted concentric with said third pivot axis.

6. The excavator apparatus as claimed in claim 5 wherein said second means for receiving said beam of laser radiation comprises a plurality of receiver units disposed along said stick arm boom to generate an output level signal when impinged by said laser radiation, said output level signal reflecting the horizontal position of said plurality of receiver units with respect to a bench mark position.

7. A method of establishing the working depth of a bucket attached to an excavating machine having an extension boom pivotably attached about a first pivot axis at one end to said excavating machine, a stick arm boom pivotably attached about a second pivot axis to the opposite end of said extension boom, a digging bucket having cutting teeth pivotably attached about a third pivot axis to the end of said stick arm boom opposite to that to which said extension boom is attached, and power means for producing relative pivotal movement of the pivotably interconnected elements, said method comprising the steps of:

establishing a reference plane with respect to a bench mark position;

establishing a reference plane signal by generating an angularly rotating laser beam in said reference plane at a preselected orientation with respect to a bench mark;

storing said reference plane signal;

selecting a second point on said digging bucket;

operating said power means to cause a momentary correspondence between said second point and said reference plane;

producing a first signal indicative of the horizontal location of said digging bucket from said reference plane using a depth sensor mounted to said third pivot axis;

producing a second signal indicative of the angular position of said digging bucket about said third pivot axis;

combining said reference plane signal, first signal and second signal to produce a depth signal indicative of the distance of said cutting teeth of said digging bucket from said reference plane;

selecting a desired distance from said reference plane that it is desired for said cutting teeth of said digging bucket to excavate to;

comparing said depth signal with said desired distance; and displaying said comparing step on a visual output in the cab of said excavating machine whereby an operator of said machine may visually inspect said visual output.

8. The method as claimed in claim 7 wherein said step of establishing a reference plane includes establishing a reference plane that is generally horizontal whereby the operator of said excavating machine manipulates said cutting teeth of said digging bucket to a level grade.

9. The method as claimed in claim 7 further comprising the steps of:

producing a third signal indicative of the angular position of said stick arm boom;

establishing a second reference plane by aligning said second and third pivot axes with said cutting teeth in a direct vertical alignment to produce a second reference plane signal;

zeroing out said second and third signals upon establishing said second reference plane signal, and wherein said step of combining comprises combining said reference plane signal, second reference plane signal, first signal, second signal and third signal to produce a depth signal indicative of the instantaneous distance of said cutting teeth of said digging bucket from said first and second reference planes; and storing said first and second reference plane signals;

whereby said visual display is monitored by the operator of said excavating machine such that a nonlevel grade is excavated.

10. An excavator apparatus for use with a laser emitting a planar laser beam at a predetermined elevation for controlling the working depth of a bucket of an excavating machine having an extension boom pivotably attached about a first pivot axis at one end to said excavating machine, a stick arm boom pivotably attached about a second pivot axis to the opposite end of said extension boom, a digging bucket pivotably attached about a third pivot axis to the end of said stick arm boom opposite to that to which said extension boom is attached, and power means for producing relative pivotal movement of the pivotably interconnected elements, said excavating apparatus comprising:

laser beam radiation transmitter means mounted proximate said stick arm boom for projecting a beam of laser radiation at a reference level;

means for receiving said beam of laser radiation mounted to said stick arm boom of said excavating machine, said laser beam radiation transmitter means and said means for receiving said beam of laser radiation establishing a reference level signal;

means for sensing a depth signal indicative of the working depth of said bucket relative to said reference level, said depth signal sensing means mounted concentrically with said third pivot axis and generating a depth signal indicative of the position of said third pivot axis with respect to said reference height and the angle of said digging bucket about said third pivot axis;

means for communicating said reference level signal and said depth signal to the operator's cab of said excavating machine; and calculating control computing means mounted in said operator's cab for receiving said reference level signal and depth signal to calculate said working depth of said digging bucket, said computing means including means for communicating and displaying said working depth such that the operator of said excavating apparatus visually monitors said working depth.

* * * * *

UNITED STATES PATENT AND TRADEMARK OFFICE

CERTIFICATE OF CORRECTION

PATENT NO. : 5,682,311

DATED : October 28, 1997

INVENTOR(S) : George J. Clark

It is certified that error appears in the above-identified patent and that said Letters Patent is hereby corrected as shown below:

Column 4, line 34, kindly delete "which" and insert ---- that ----.

Column 4, line 35, kindly delete "an" and insert ---- can ----.

Column 6, line 6, kindly delete "then".

Column 7, lines 31 and 62 kindly delete "excavating" and insert ----excavator ----.

Column 7, line 46, kindly delete "height" and insert ---- level ----.

Column 7, line 60, kindly delete "apparatus" and insert ---- machine ----.

Column 9, line 18, after "said" first occurrence, kindly insert ---- excavating ----.

Column 10, line 14, kindly delete "excavating" and insert ---- excavator ----.

UNITED STATES PATENT AND TRADEMARK OFFICE

CERTIFICATE OF CORRECTION

PATENT NO. : 5,682,311

DATED : October 28, 1997

INVENTOR(S) : George J. Clark

It is certified that error appears in the above-identified patent and that said Letters Patent is hereby corrected as shown below:

Column 10, line 28, kindly delete "height" and insert

---- level ----.

Column 10, line 38, kindly delete "apparatus" and insert

---- machine ----

Signed and Sealed this

Eighteenth Day of May, 1999

*Attest:*

*Attesting Officer*

Q. TODD DICKINSON

*Acting Commissioner of Patents and Trademarks*